United States Patent [19]

Berghuis et al.

[11] Patent Number: 4,571,909

[45] Date of Patent: Feb. 25, 1986

[54] INSULATED BUILDING AND METHOD OF MANUFACTURING SAME

[75] Inventors: Thomas G. Berghuis, Appleton; James A. Propson, Hilbert, both of Wis.

[73] Assignee: Keller Structures, Inc., Kaukauna, Wis. ; a part interest

[21] Appl. No.: 649,834

[22] Filed: Sep. 7, 1984

[51] Int. Cl.[4] ..... E04C 1/00; E04C 2/34; E04B 1/74; E04B 2/00

[52] U.S. Cl. ..... 52/309.8; 52/309.9; 52/309.11; 52/404; 52/426; 52/809

[58] Field of Search ..... 52/235, 309.8, 309.9, 52/309.11, 404, 826, 809

[56] References Cited

U.S. PATENT DOCUMENTS

| | | | |
|---|---|---|---|
| 2,896,271 | 7/1959 | Kloote et al. | 20/4 |
| 2,962,323 | 11/1960 | McBride | 296/28 |
| 3,230,681 | 1/1966 | Allen et al. | 52/309 |
| 3,258,889 | 7/1966 | Butcher | 52/309 |
| 3,332,170 | 7/1967 | Bangs | 49/400 |
| 3,432,979 | 3/1969 | Heimann | 52/309 |
| 3,470,058 | 9/1969 | Heffner | 52/309 X |
| 3,496,689 | 2/1970 | Nerem | 52/204 |
| 3,583,118 | 6/1971 | Lowery | 52/309 |
| 3,637,252 | 1/1972 | Metsker | 52/309 X |
| 3,760,548 | 9/1973 | Sauer et al. | 52/593 |
| 4,044,511 | 8/1977 | Lingle | 52/127 |
| 4,068,434 | 1/1978 | Day et al. | 52/220 |
| 4,078,348 | 3/1978 | Rothman | 52/309.11 X |
| 4,104,840 | 8/1978 | Heintz et al. | 52/309.9 |
| 4,158,938 | 6/1979 | Meechan et al. | 52/309.11 X |
| 4,163,349 | 8/1979 | Smith | 52/241 |
| 4,190,305 | 2/1980 | Knight et al. | 52/309.2 X |
| 4,288,962 | 9/1981 | Kavanaugh | 52/743 |
| 4,310,992 | 1/1982 | Thabet | 52/309.11 |
| 4,346,541 | 8/1982 | Schmitt | 52/309.11 |
| 4,394,026 | 7/1983 | Kaiser et al. | 277/231 |
| 4,402,167 | 9/1983 | Denucci | 52/246 |
| 4,403,980 | 9/1983 | Simpson et al. | 52/309.11 |

*Primary Examiner*—Michael R. Lusignan

*Attorney, Agent, or Firm*—Andrus, Sceales, Starke & Sawall

[57] ABSTRACT

An insulated building has an inner structure forming the interior walls and roof of the building. Elongated wood spacer members are mounted on the exterior of the inner structure preferably with insulated fasteners. The spacer members are spaced from the exterior of the inner structure. Foam insulation covers the exterior of the inner structure to a depth generally flush with the spacer members. Sheeting is applied over the foam to cover the exterior of the building. The building is characterized by an absence of panel joints typically found in buildings of this type. Such joints permit detrimental heat transfer through the insulation.

14 Claims, 6 Drawing Figures

INSULATED BUILDING AND METHOD OF MANUFACTURING SAME

The present invention relates to an insulated building and to a method of making same. Such a building is typically used as a refrigerated warehouse or the like. More specifically, the present invention relates to a such a building exhibiting improved insulation properties and employing a preengineered or prefabricated metal structure.

Insulated buildings commonly serve as refrigerated or freezer warehouses for food or other products that must be kept at reduced temperatures. Current construction techniques employ insulated panels fastened to a steel framework. The panels are typically three feet wide and comprise an insulating material, such as foam, sandwiched between two sheets of metal.

However, the joints between such panels present paths for heat transfer, thereby reducing the effectiveness of the insulation of the building. Numerous types of seals have been devised in an effort to seal the joints between the panels and reduce heat transfer. However, none of these seals have proven completely effective, particularly over the extended life of the building.

It is, therefore, the object of the present invention to provide an improved insulated building in which the integrity of the insulation is greatly improved by the avoidance of heat transfer paths, such as panel joints, through the insulation. In spite of its insulating properties, the improved building of the present invention is simple and economical in construction, manufacture, and maintenance.

Briefly, the insulated building of the present invention has an inner structure forming the interior walls and roof of the building. The inner structure may comprise a prefabricated building erected on site. Elongated moisture resistant treated wood spacer members are mounted on the exterior of the inner structure with fasteners. The spacer members are spaced from the exterior of the inner structure. The fasteners may comprise counter sunk bolts. The bolts are surrounded by insulating sleeves in the space between the spacer members and the exterior of the inner structure.

Foam insulation covers the entire exterior of the inner structure to a depth generally flush with the outer edges of the spacer members. The foam insulation extends under the spacer members to generally embed the spacer members in the insulation. The foam may be covered with a high integrity vapor barrier. Metal sheeting is applied over the foam to cover the exterior of the building.

The building so formed is characterized by a highly effective insulation due to the absence of panel joints typically found in buildings of this type. As noted above, such joints, if present, permit detrimental heat transfer through insulation.

The invention will be further understood by the aid of the drawing and following specification. In the drawing.

Figure 1:
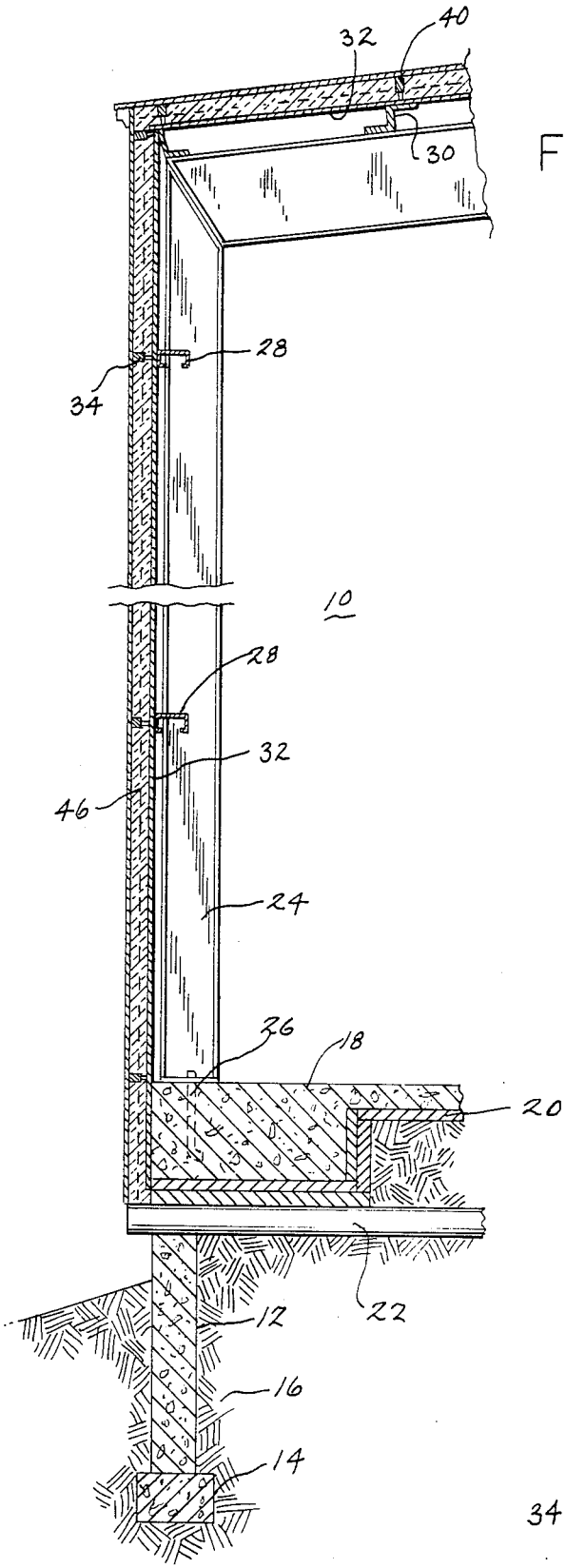
FIG. 1 is a partial cross-sectional view through the improved building of the present invention.

As shown in FIG. 1, building 10 is mounted on retaining wall 12 supported on footing 14 in ground 16. Floor 18 for building 10 is positioned on foundation wall 12. To enhance the insulating characteristics of the building, expanded polystyrene planks 20 may be placed on ground 16 before floor 18 is poured. A vapor barrier film may be applied to both exposed sides of planks 20. Ventilating pipe 22 extends under floor 18 and insulating planks 20 and through foundation wall 12.

The frames 24 are erected on floor 18 and secured to the floor with anchor bolts 26. Girts 28 extend between the vertical portions of frames 24 and purlins 30 extend between the rafter portions. Frames 24 are then covered with corrugated metal sheeting 32 fastened to the girts and purlins so as to complete an inner structure of building 10 comprising a metal building of conventional construction and erection.

Figure 2:
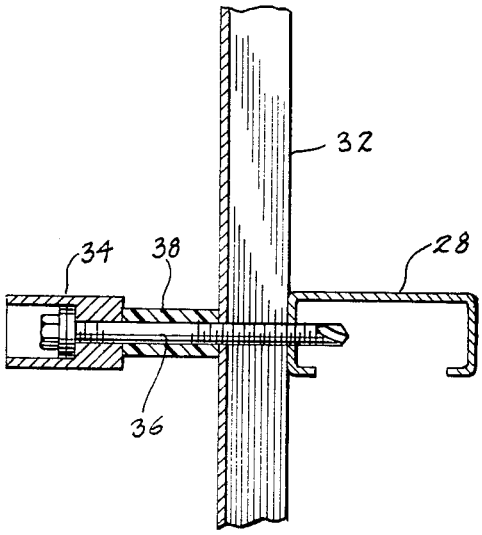
FIG. 2 is a fragmentary view showing an initial step in the construction of the improved insulated building.
Figure 4:
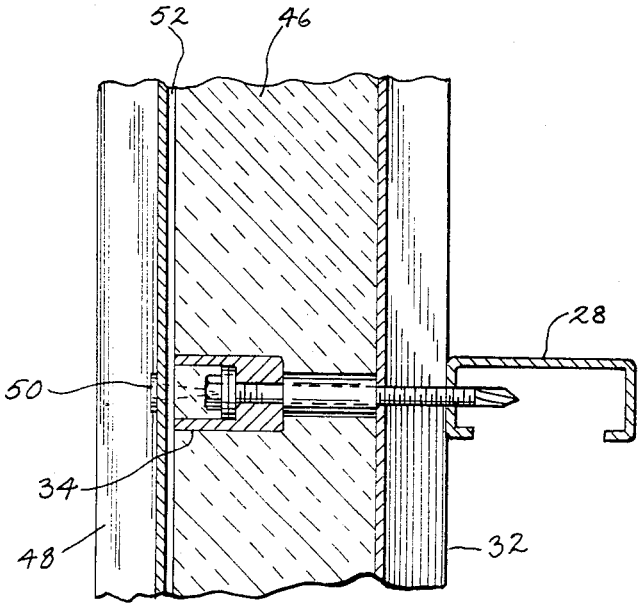
FIG. 4 shows a final step in the construction of the improved building of the present invention.
Figure 6:
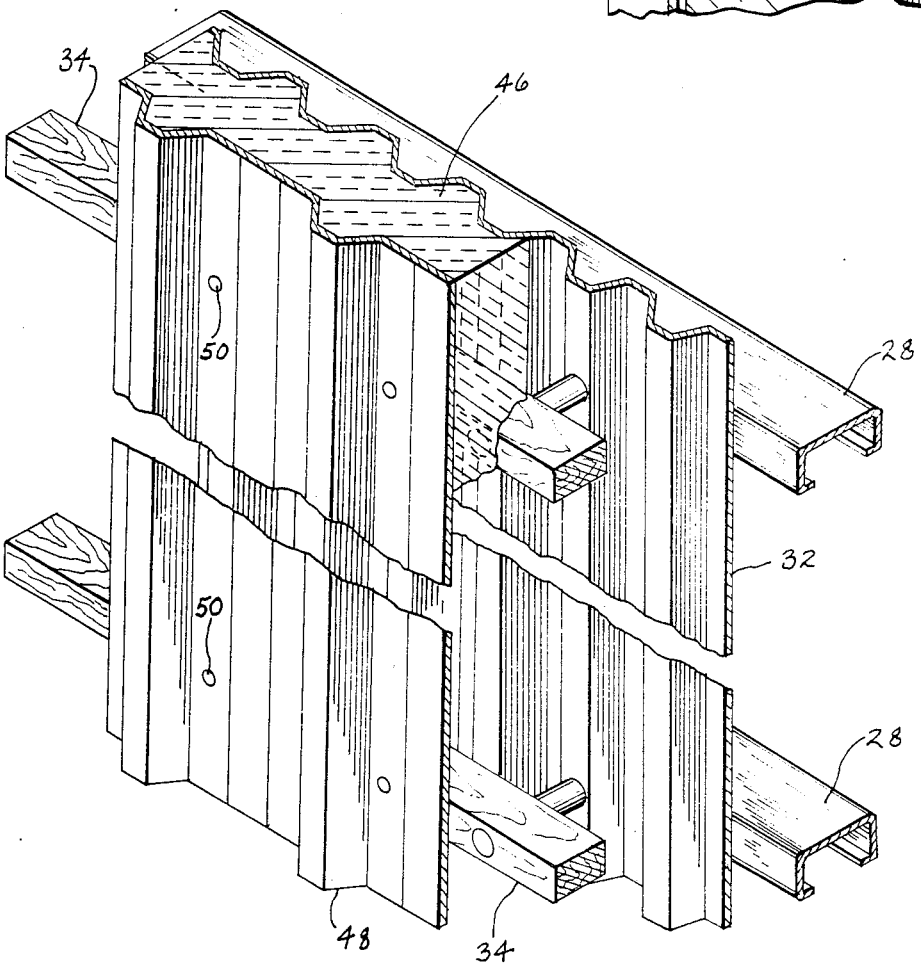
FIG. 6 is a partial perspective cutaway view of a portion of the improved building of the present invention showing the construction features.

To insulate the inner structure to form insulated building 10 of the present invention, sub-girts 34 are applied to the exterior of the inner structure. As shown in FIGS. 2 and 4, sub-girts 34 may comprise 2×4" treated wood members having countersunk holes for receiving fasteners 36 that fasten sub-girts 34 to girts 28. Fasteners 36 may comprise bolts of a type suitable for use with a power applicator. Self-threading bolts of this type are shown in the Figures. Or the bolts may be of the conventional type utilizing nuts to make the attachment. If desired, a force transmitting washer and/or insulating washer may be positioned under the head of bolt 36. As shown in FIG. 2, sub-girts 34 are spaced from sheeting 32 by sleeves 38 surrounding bolts 36. Sleeves 38 may be formed of a material having insulating properties and may comprise lengths of polyvinylchloride plastic pipe. Sub-purlins 40 are applied across the roof of the inner structure in a manner corresponding to that shown in detail in connection with sub-girts 34. The space between the sub-girts and sub-purlins and sheeting 32 may vary depending on the thickness of insulation required for building 10.

Figure 5:
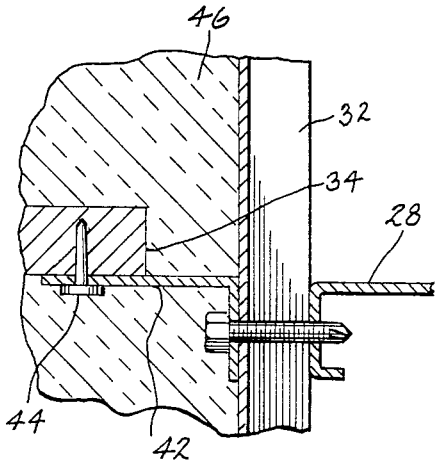
FIG. 5 is a fragmentary cross sectional view showing a modification of the building of the present invention.

Or, as shown in FIG. 5, L-shaped brackets 42 may be used to apply subgirts and sub-purlins 40 to the exterior of the inner structure. Brackets 42 are attached to the inner structure by fasteners 36 and nailed to the sub-girt or sub-purlin by nails 44.

Figure 3:
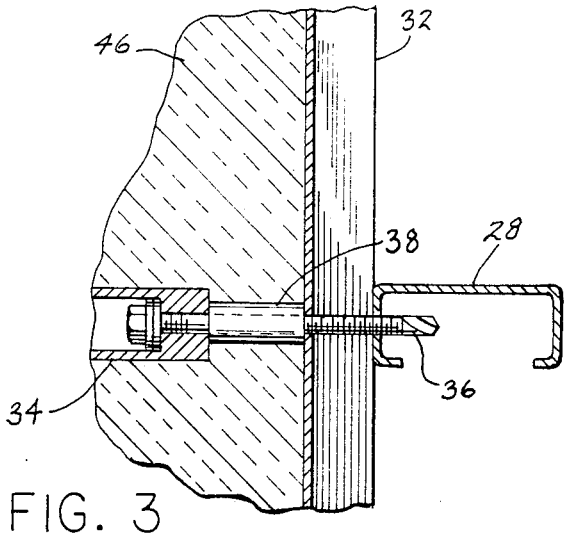
FIG. 3 is a cross-sectional view similar to FIG. 2 showing a subsequent step in the construction of the building.

The exterior of the inner structure of building 10 is then covered with a foam insulation 46 as shown in FIG. 3. Foam insulation may comprise a spray-on urethane foam. The countersunk holes in sub-girts 34 and sub-purlins 40 are also filled with the foam. Foam insulation 46 extends under sub-girts 34 and sub-purlins 40 in the space between the sub-girts and sub-purlins and sheeting 32 and embeds the sub-girts and sub-purlins in the foam. As shown in FIG. 1, foam insulation 46 extends continuously around the eve of building 10 and extends past floor 18 to mate with insulation 20. The entire inner building structure is thus placed in an integral, seamless, insulated envelope that surrounds the inner structure. The wood of sub-girts 34 and sub-purlins 40 possess good insulating properties. Insulating sleeves 38 prevent heat transfer through fasteners 36.

After foam insulation 46 has been applied, the building is covered on the sides and roof with steel sheeting 48 to complete the building and give it a finished appearance. Foam 46 can ordinarily be applied so that it is sufficiently flush with the outer edges of sub-girts 34 and sub-purlins 40 to permit easy application of sheeting 48. If necessary, any high spots in the foam beyond the outer surface of the sub-girts and sub-purlins can be planed down prior to covering the building with the sheeting. Sheeting 48 can be fastened to the sub-girts and sub-purlins with appropriate fasteners 50 shown in FIG. 4. The foam may be covered with a high integrity vapor barrier 52, also as shown in FIG. 4.

As will be apparent from the foregoing description, building 10 of the present invention thus provides a building insulated in a highly effective manner and without the panel joints and attendant heat transfer commonly found in buildings of this type.

Various modes of carrying out the invention are contemplated as being within the scope of the following claims particularly pointing out and distinctly claiming the subject matter which is regarded as the invention.

We claim:

1. An insulated building comprising:

an inner structure forming the interior walls and roof of the building;

spacer means mounted on the exterior of said inner structure, said spacer means extending at intervals along the walls and roof of said inner structure and comprising elongated members, said elongated members being located at a distance from the exterior of said inner structure, said elongated members being mounted on said inner structure by fasteners, so constructed as to avoid a heat transfer path through the insulation, said fasteners being applied at intervals along said elongated members;

insulating foam covering the entire exterior of said inner structure except for the areas occupied by said fasteners, said insulating foam covering to a depth generally flush with the outer edges of said spacer means, said foam embedding said spacer means and forming a seamless, integral insulation for the building; and sheeting applied over said foam and spacer means to cover the foam on the exterior of the building.

2. The insulated building according to claim 1 further including a high integrity vapor barrier covering said insulating foam.

3. The insulated building according to claim 1 wherein said elongated members are mounted on said inner structure by fasteners extending through countersunk holes in said elongated members, and wherein said countersunk holes are filled with foam.

4. The insulated building according to claim 1 wherein said fasteners are surrounded by insulating sleeves intermediate the elongated member and exterior of said inner structure to avoid heat transfer through the fasteners.

5. The insulated building according to claim 2 wherein said elongated members are formed of wood.

6. The insulated building according to claim 1 wherein said insulating foam is urethane foam.

7. An insulated building comprising:

an inner structure forming the inner walls and roof of the building;

elongated members mounted on the exterior of said inner structure at intervals along the walls and roof of said inner structure, said elongated members being located at a distance from the exterior of said inner structure, said elongated members being mounted on said inner structure by brackets fastened to said inner structure and elongated members and applied at insulating foam covering the entire exterior of said inner structure except for the areas occupied by said brackets, said insulating foam covering to a depth generally flush with the outer edges of the elongated members, said foam embedding the elongated members and forming a seamless, integral insulation for said building; and sheeting means applied over said foam and spacer means to cover the exterior of the building.

8. The insulated building according to claim 7 wherein said elongated members are formed of wood.

9. The insulated building according to claim 7 wherein said insulating foam is urethane foam.

10. The insulated building according to claim 7 including a high integrity vapor barrier covering said insulating foam.

11. A method of constructing an insulated building comprising the steps of:

erecting an inner structure having walls and a roof;

attaching a plurality of elongated members at intervals along the exterior of the walls and roof with insulated fasteners applied at intervals along the elongated members, said elongated members being located at a distance from the exterior of the inner structure;

applying foam to the exterior of the inner structure to form a seamless, integral insulation for the building, said foam being applied to a depth generally flush with the outer edges of the elongated members; and covering the foam with sheeting to form the exterior of the building.

12. The method according to claim 11 further defined as applying a high integrity vapor barrier over the foam.

13. A method of constructing an insulated building comprising the steps of:

erecting an inner structure having walls and a roof;

attaching a plurality of elongated members at intervals along the exterior of the walls and roof with brackets applied at intervals along the elongated members, said elongated members being located at a distance from the exterior of the inner structure;

applying foam to the exterior of the inner structure to form a seamless, integral insulation for the building, said foam being applied to a depth generally flush with the outer edges of the spacer means; and covering the foam with sheeting to form the exterior of the building.

14. The method according to claim 13 further defined as applying a high integrity vapor barrier over the foam.

* * * * *

UNITED STATES PATENT AND TRADEMARK OFFICE

CERTIFICATE OF CORRECTION

PATENT NO. : 4,571,909

DATED : February 25, 1986

INVENTOR(S) : THOMAS G. BERGHUIS ET AL

It is certified that error appears in the above-identified patent and that said Letters Patent is hereby corrected as shown below:

Column 4, Line 11, Claim 7, After "applied at" insert ---intervals along said elongated members---

Signed and Sealed this

*Seventeenth* Day of *June 1986*

[SEAL]

*Attest:*

DONALD J. QUIGG

*Attesting Officer*

*Commissioner of Patents and Trademarks*